US006170820B1

(12) United States Patent
Hutson

(10) Patent No.: US 6,170,820 B1
(45) **Date of Patent: *Jan. 9, 2001**

(54) ROLLER BIASING FOR SHEET ENGAGEMENT

(75) Inventor: Sammy Cline Hutson, West Bloomfield, MI (US)

(73) Assignee: Unisys Corporation, Blue Bell, PA (US)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 08/928,232

(22) Filed: Sep. 12, 1997

(51) Int. Cl.[7] ..... B65H 5/02; B65H 5/04

(52) U.S. Cl. ..... 271/274; 271/265.01; 271/270; 271/272; 271/273; 198/502.1; 198/502.4

(58) Field of Search ..... 400/582, 578, 400/636, 636.3; 271/265.01, 270, 272, 273, 274, 264, 294, 314; 198/502.1, 502.4, 624

(56) References Cited

U.S. PATENT DOCUMENTS

| | | | | |
|---|---|---|---|---|
| 3,618,934 | * | 11/1971 | Germuska | 271/51 |
| 3,893,662 | * | 7/1975 | Boyd | 271/10 |
| 4,018,433 | * | 4/1977 | Woods | 271/80 |
| 4,297,045 | * | 10/1981 | Burton et al. | 400/641 |
| 4,350,334 | * | 9/1982 | Quinton | 271/274 |
| 4,506,878 | * | 3/1985 | Bashford | 271/227 |
| 5,098,078 | * | 3/1992 | Nakanishi | 271/10 |
| 5,324,019 | * | 6/1994 | Chang et al. | 271/124 |
| 5,520,383 | * | 5/1996 | Amagai et al. | 271/265.01 |
| 5,598,201 | * | 1/1997 | Stodder et al. | 347/104 |
| 5,662,321 | * | 9/1997 | Borostyan et al. | 271/10.03 |
| 5,913,511 | * | 6/1999 | Miyauchi | 271/9.09 |
| 5,915,691 | * | 6/1999 | Deguchi et al. | 271/265.01 |

FOREIGN PATENT DOCUMENTS

| | | | | |
|---|---|---|---|---|
| 63-57452 | * | 3/1988 | (JP) | 271/272 |
| 1-162654 | * | 6/1989 | (JP) | 271/272 |
| 3-216452 | * | 9/1991 | (JP) | 271/272 |
| 4-116044 | * | 4/1992 | (JP) | 271/272 |

* cited by examiner

*Primary Examiner*—Donald P. Walsh
*Assistant Examiner*—David A Jones
(74) *Attorney, Agent, or Firm*—David G. Rasmussen; Mark T. Starr; Lise A. Rode

(57) ABSTRACT

A sheet transport array for advancing sheets along a track at a desired speed past a process station. A sheet speed measuring device is coupled to the process station. A drive roller assembly includes at least a drive roller and a drive idler, with the drive roller driving the advancing sheet at the desired speed toward the process station. A second roller assembly includes at least a second roller and a second idler, with the second idler moving at the speed of the advancing sheet. A floating roller assembly includes at least a floating roller and a floating idler. The floating idler is coupled to the second idler to move at the same speed as the second idler and the advancing sheet. The floating roller and the floating idler define a pinch point with a pinch force such that the floating roller and the floating idler move at the same speed. The floating roller is coupled to the speed measuring device so that the speed measuring device measures the speed of the advancing sheet prior to the advancing sheet making contact with the floating roller assembly.

13 Claims, 10 Drawing Sheets

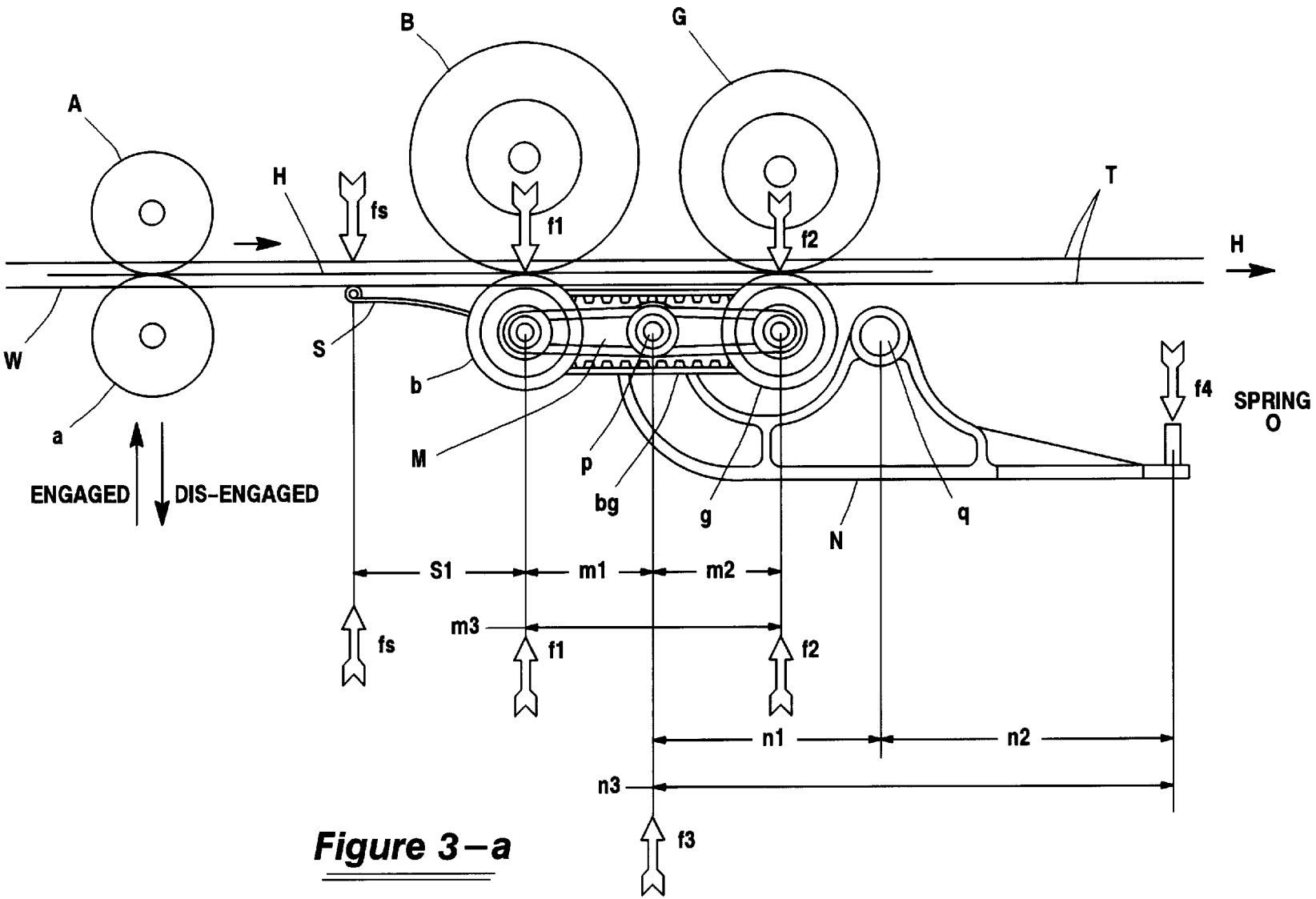
Figure 3–a

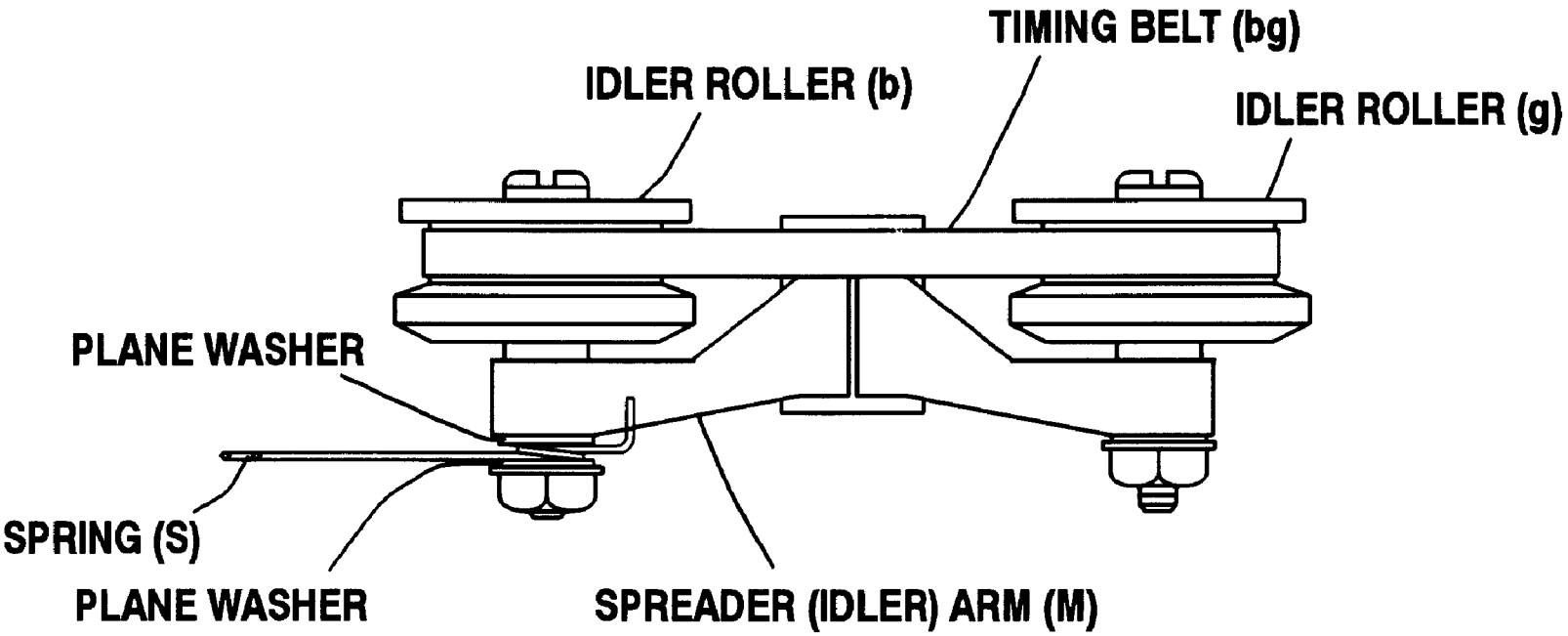
*Figure 3–b*

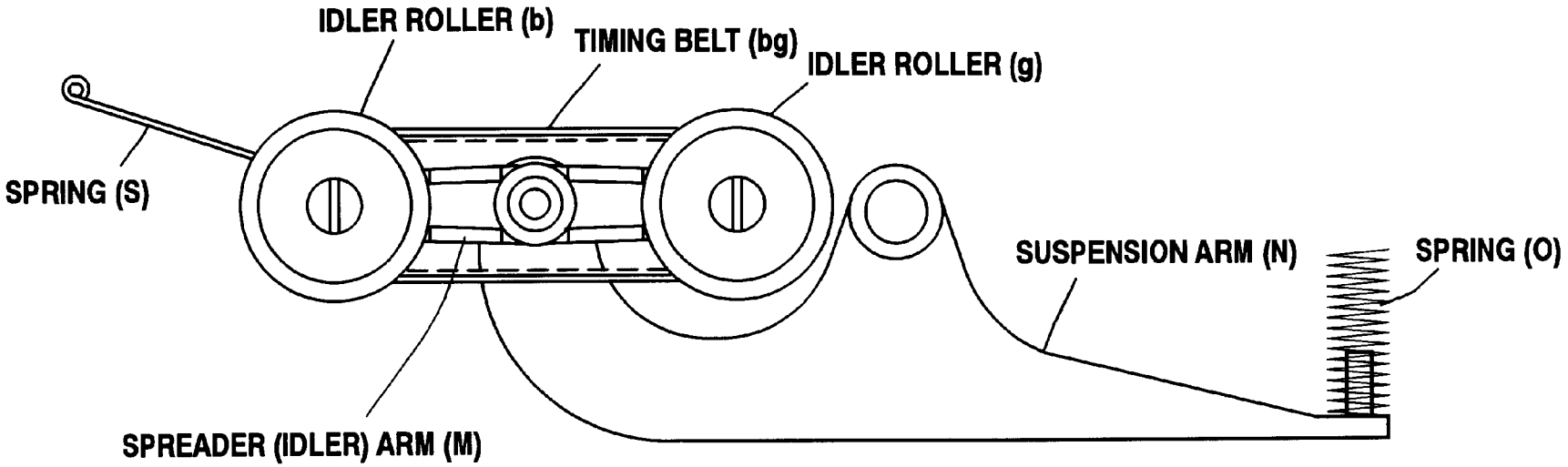
Figure 3–c

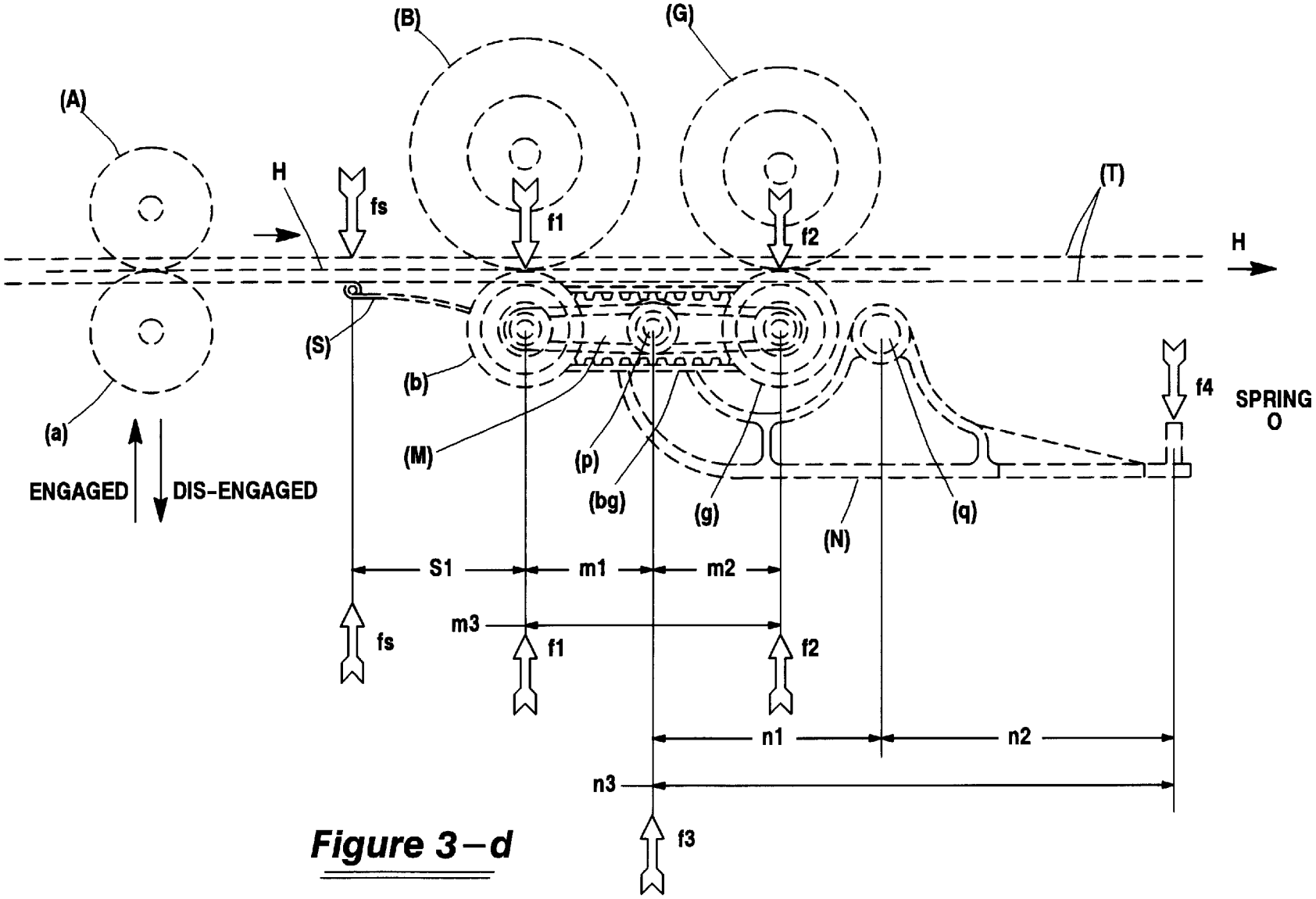
Figure 3–d

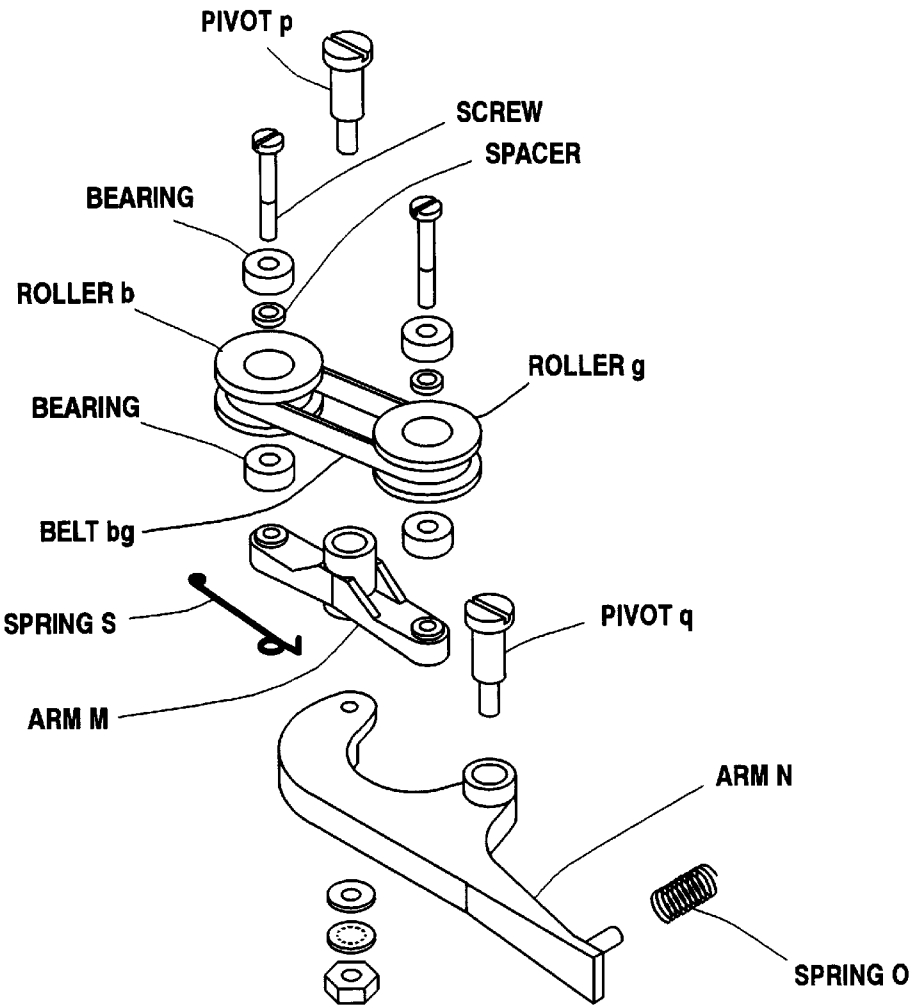
Figure 4–a

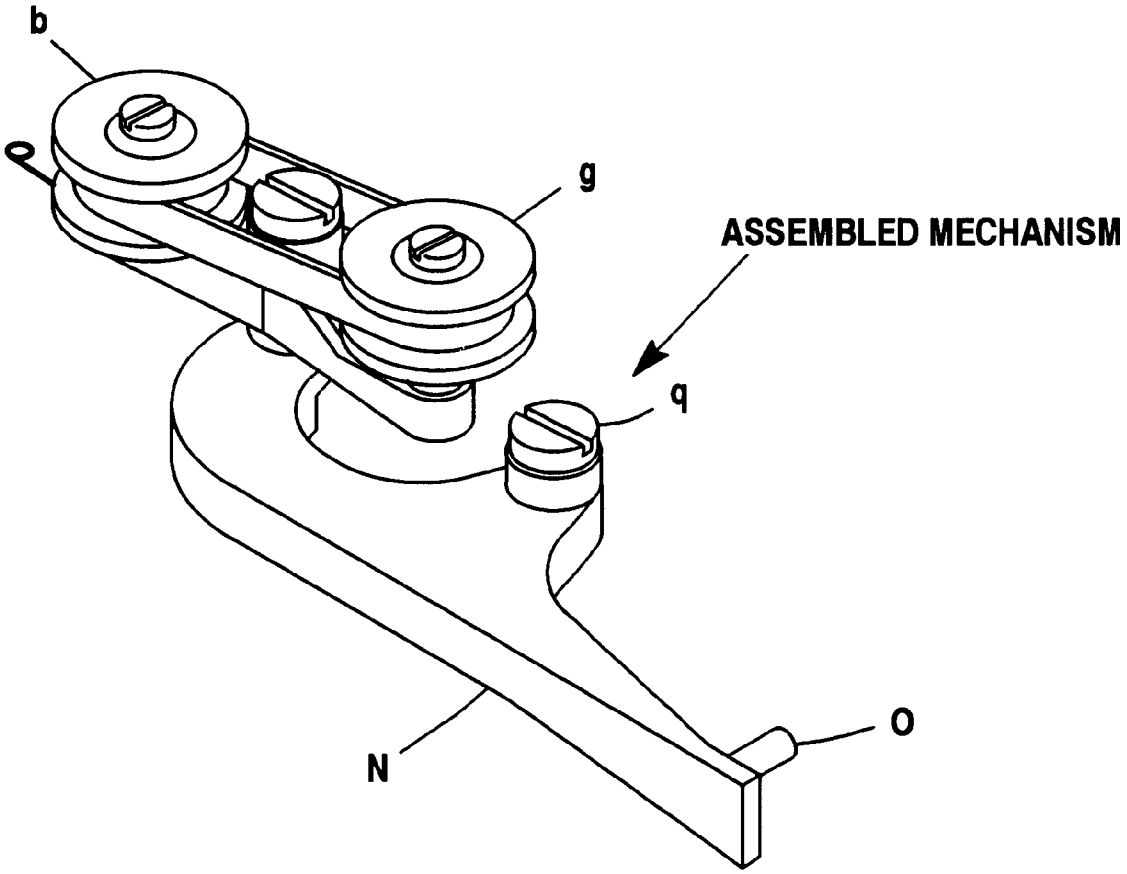
Figure 4–b

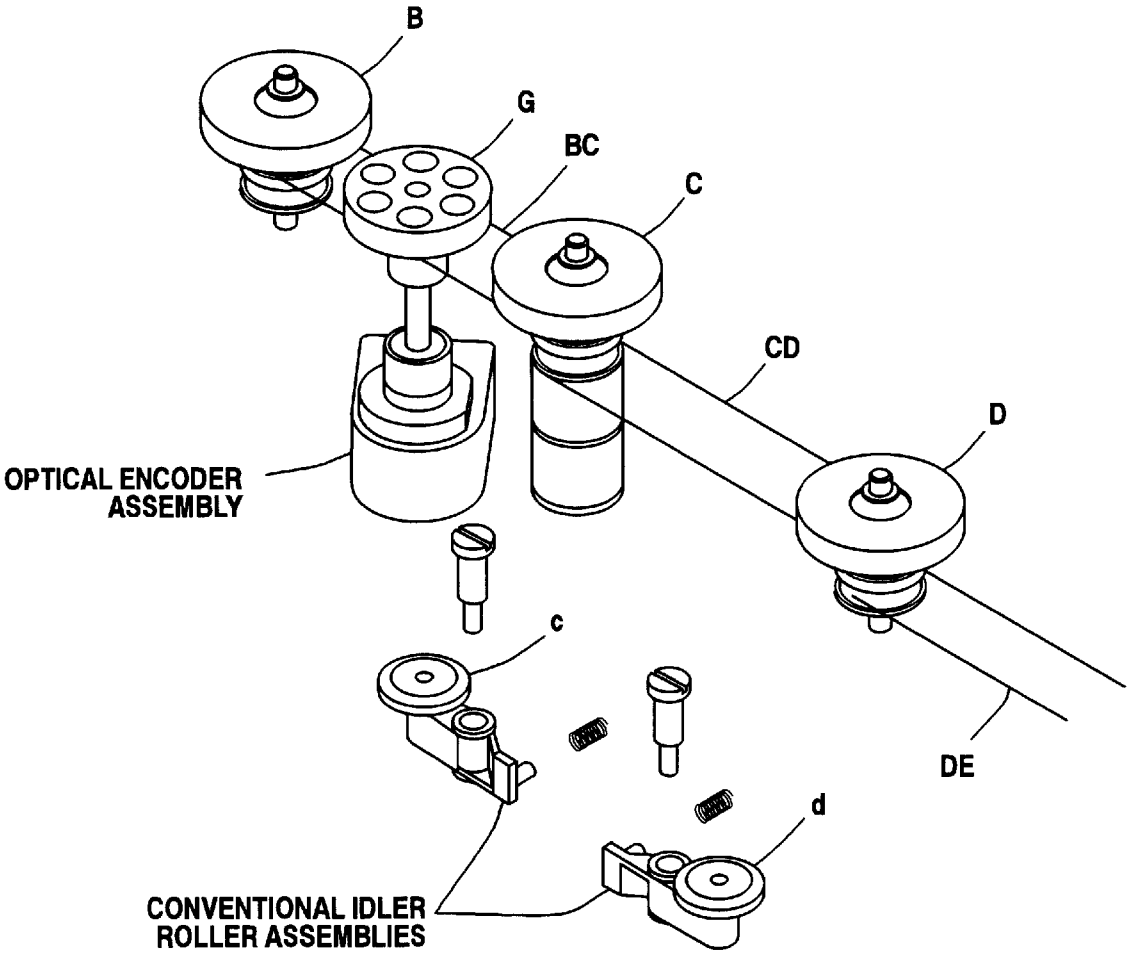
Figure 4–c

ROLLER BIASING FOR SHEET ENGAGEMENT

This relates to item-handling systems and apparatus, and especially techniques for arranging for associated transport rollers and idlers.

BACKGROUND FEATURES

Workers in the art of handling and transporting items appreciate that, at times, an item is to be selectively advanced either at high speed, or at a relatively low speed (e.g. to pass a special processing station). If, as is common, the station needs "firing pulses" to synchronize with item travel, a firing means may advantageously provide this by tracking the document directly. But doing so will commonly involve a "power take-off" (e.g. where document motion is used to activate this) which, in turn, presents the problem of retarding the thing you are tracking.

This invention addresses this problem and provides "floating" pulse encoder means, together with "encoder engagement means adapted to accommodate varying document thickness and "balanced pressure means" to adjust document-engagement forces.

Such features and advantages are a salient object hereof.

Other objects and advantages of the present invention will be apparent to those skilled in the art.

A sheet transport array for advancing sheets along a track at a desired speed past a process station. A sheet (for example, a check) advances along a track and is decelerated to pass through a process station, for example an ink encoder. The sheet enters a drive roller assembly having a drive roller and a drive idler that decelerates the advancing sheet as it passes the process station. A second roller assembly includes at least a second roller and a second idler. The second idler moves at the higher speed of the advancing sheet. The second roller is still moving at the normal high document speed of the track but slips on the document that remains at the lowered speed. The document continues along the track toward a floating roller assembly including at least a floating roller and a floating idler, neither of which is driven. The floating idler is coupled by a belt to the second idler so as to move at the same speed as the second idler and hence the advancing sheet. The floating roller and floating idler have a pinch point with a pinch force such that the floating roller and floating idler move at the same speed as the advancing sheet.

Before the advancing sheet reaches the floating roller assembly the floating roller drives a speed measuring device at the speed of the advancing sheet. As the advancing sheet reaches the pinch point for the floating roller assembly the floating roller and floating idler are moving at the same speed as the advancing sheet and the advancing sheet is not slowed down. As the document enters the pinch point the advancing document takes over in driving the floating roller. The floating idler no longer controls the floating roller speed. This allows the advancing document to control the speed measuring device and hence signal to the process station. This is important because the size of the document may be such that the document has left the original slower drive roller and is accelerating. The speed measuring device, for example, may be an optical encoder that measures the speed of the advancing sheet and provides a control signal to an ink endorser process station to control the ink encoding on the advancing sheet.

BRIEF DESCRIPTION OF DRAWINGS

The advantages and features of the present invention will be appreciated by workers as they become better understood by reference to the following detailed description of the present preferred embodiments, these being considered in conjunction with the accompanying drawings, wherein like reference symbols denote like elements:

FIG. 4B depicts mount arms for such an embodiment by itself, with FIG. 4A depicting this embodiment with parts exploded-away, and FIG. 4C showing related ports.

DETAILED DESCRIPTION OF PREFERRED EMBODIMENTS

This disclosure describes a mechanism to drive an optical encoder speed measuring device, such as for measuring document speed and acceleration in a UNISYS DP500 document processing machine, (by UNISYS Corp., Blue Bell, Pa.) and applicable to any such system calling for the accurate measurement of variable linear velocity (e.g. of a document H).

As is known from conventional design wisdom, and as dictated by the laws of physics, any measuring device used on a dynamic system will influence that system and will cause some change to the thing being measured. The purpose of the mechanism described here is to minimize the effect of the measurement device on a document whose speed is being measured, while improving the accuracy of the speed measurement.

Figure 1:
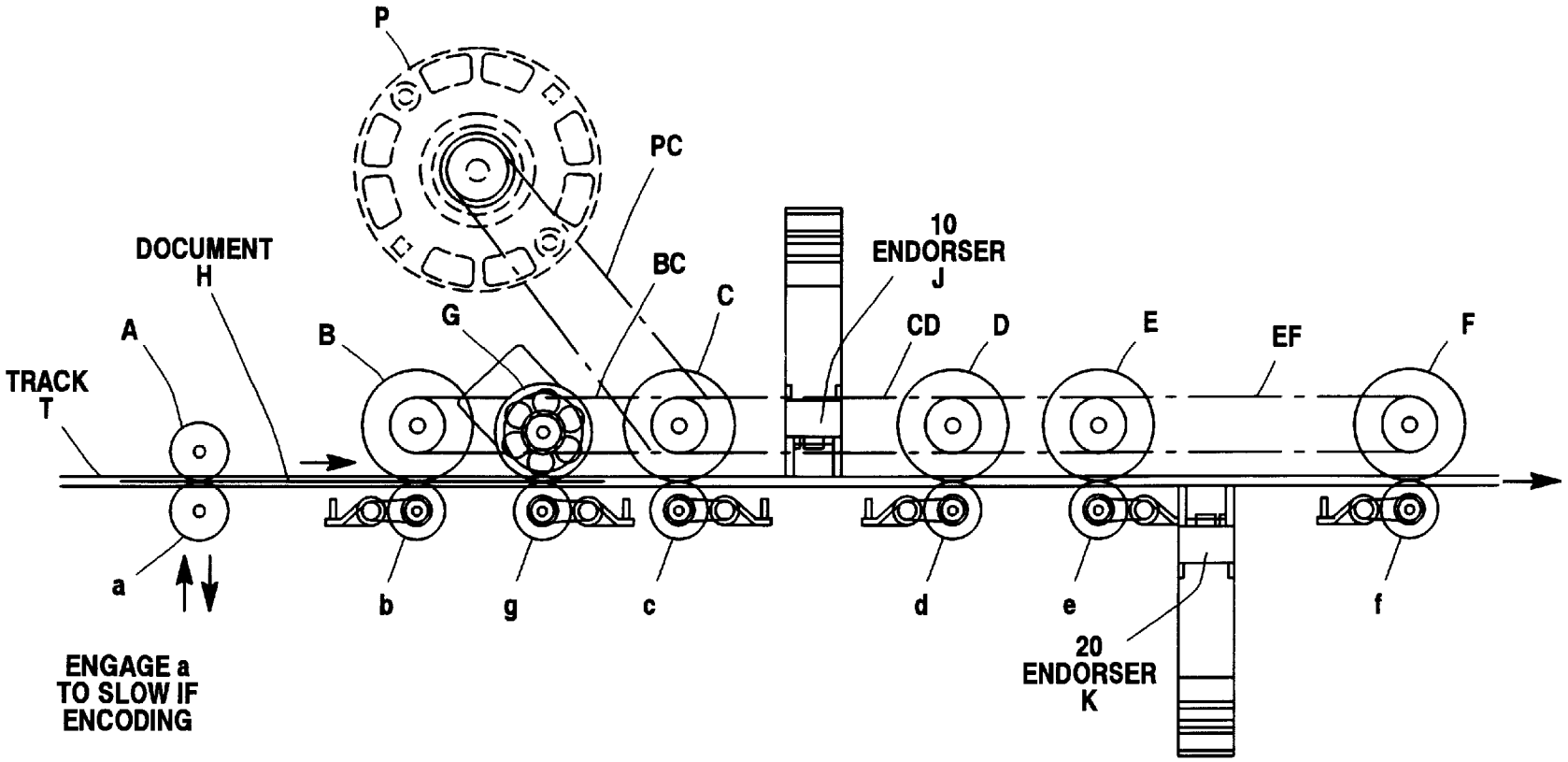
Figure 1 (Prior Art)
FIG. 1 is a schematic diagram of a document transport array, including drive rollers apt for use in/with the invention.

As depicted in FIG. 1, a document H will be understood as traveling down a DP500 transport track T (see arrow) at 100 ips (inches per second) to reach drive roller A at the entry to a low speed encoder station where document speed is to be reduced to 3.5 ips if the document is to be encoded, by selective engagement of idler roller a vs. Roller A.

Otherwise (if no encoding), document H will continue along the illustrated track segment at the same high speed (100 ips e.g. being so driven by rollers B, C, D, E, F).

Thus, idler roller a is moved into engagement with drive roll A under program control if the document is to be encoded, and then out of this engagement when the last character has been encoded, e.g., as the document reaches endorser J, or endorser K, or both. This drive mechanism can use conventional technology (e.g., as presently on the DP500 document processor). Idler rollers b, c are in constant engagement with respective drive rollers B, C although this could be changed to selective engagement if dictated by the function of the design.

The pinch forces on idler rollers a, b and c are selected so the document speed is held to 3.5 ips, for proper encoding, by roller pair A-a (i.e. drive roller assembly), even when the document is also being engaged by rollers B-b (i.e. second roller assembly) and C-c which continue to run at the 100 ips speed.

Drive rollers B through F, driven in common by motor P, through drive belt PC and transfer drive belts BC, CD, and EF, run at a constant 100 ips. The document can still be engaged by A-a, driven at 3.5 ips, when the leading edge of the document reaches the MJE (Multi Jet Endorser) J. Endorser J must be positioned this close to the encoder in order to allow space for positioning a second, optional MJE endorser K between roller pairs E-e and F-f.

The firing rate of the ink nozzles for printing with the MJE endorser on the document is dependent on document speed (if to produce print is to be legible), and this speed will change from 3.5 ips to 100 ips when encoding is complete and idler roller a is retracted. This speed change can occur at any time during the endorse printing cycle; and the acceleration rate can vary from document to document, depending on the condition of the document and a variety of environmental and machine tolerance conditions.

Figure 2:
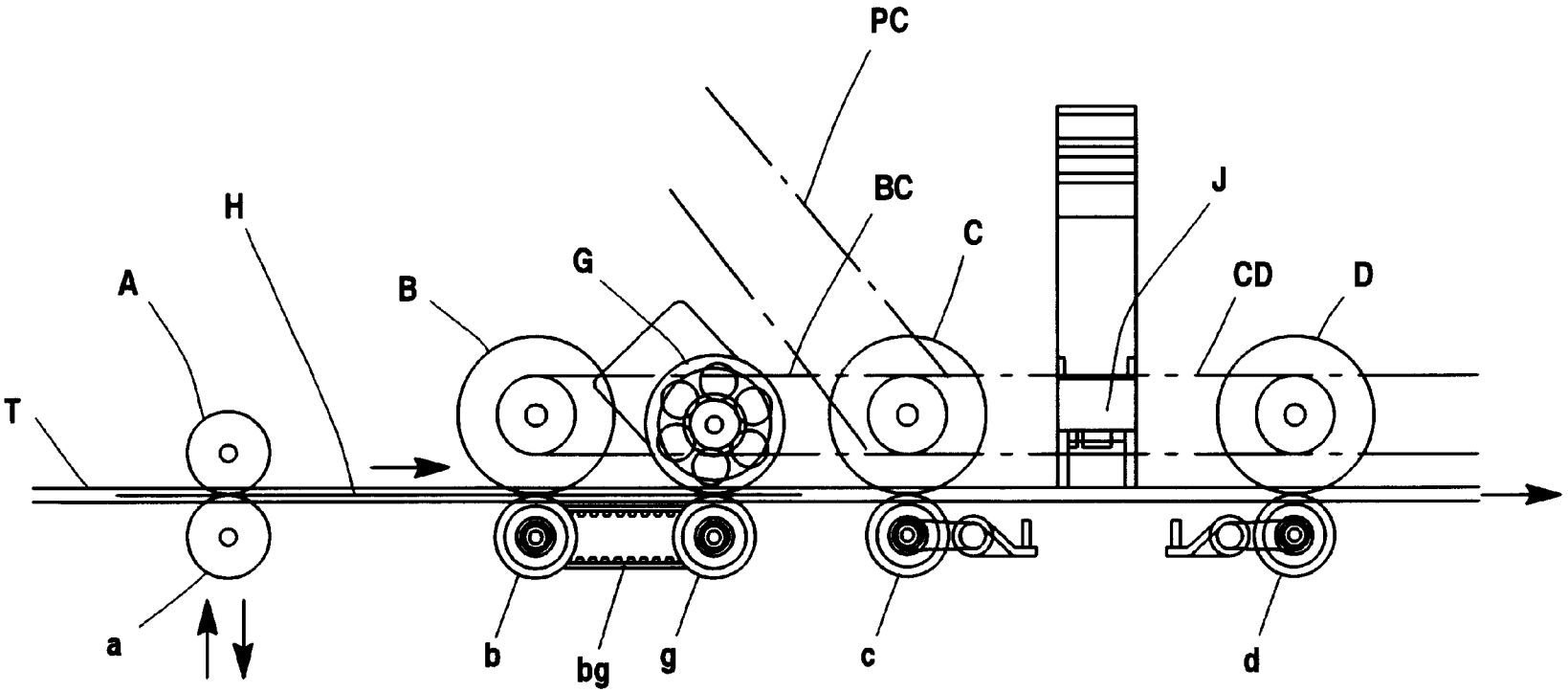
FIG. 2 illustrates a like array with a portion thereof modified to illustrate salient features in an embodiment of the invention.

The firing rate of the endorser must be accurately synchronized with this widely-varying speed in order to produce readable print on the document. This synchronization is accomplished here, preferably by positioning a "floating" roller pair G-g between roller pairs B-b and C-c, as shown in FIG. 2. Roller G is not motor driven and speed is controlled only by the document (G will be rotated only, if one is present, when idler g is engaged). Roller G drives an optical encoder disk/sensor mechanism of conventional technology (not detailed), to generate the mentioned firing pulses for endorser J, K. Roller G is sized so the optical encoder provides control signals for the MJE endorsers J, K, generating 120 pulses per inch of document-travel, as document passes between roller pair G-g. These pulses, one for every 0.0083 inches of document travel, provide the necessary firing rate control for the MJE endorser, as workers will understand.

The inertia of roller G and of the optical encoder engaged therewith, is low; also, the friction of the roller against the document under the pinch force of idler roller g is selected so there will be no slip and so the MJE controllers for J, K will thus receive a precise, accurate reading of document travel.

Without the mechanism disclosed below, and with roller G not being directly driven, roller pair G-g will be stationary when the leading edge of the document hits the rollers at 3.5 ips, or at 100 ips if the document is not being encoded. The document, being pushed by rollers A-a and B-b, must force it's way between rollers G-g and accelerate both rollers, and the optical encoder, up to document speed against the inertia and bearing friction of the mechanism.

Problems:

Even with the best of designs, this action would upset the document if done conventionally; e.g., it may cause a ripple in the document and disrupt its registration on the track floor; it may so change document acceleration as to damage the leading edge of the document and make a transport jam more likely.

To minimize this disruption, the pinch force of idler g would conventionally, have to be greatly decreased—but this would likely cause slip of the optical encoder drive roller and produce inaccurate acceleration and speed readings. This design implementation would thus become a series of compromises which would likely degrade system performance.

Figure 3:
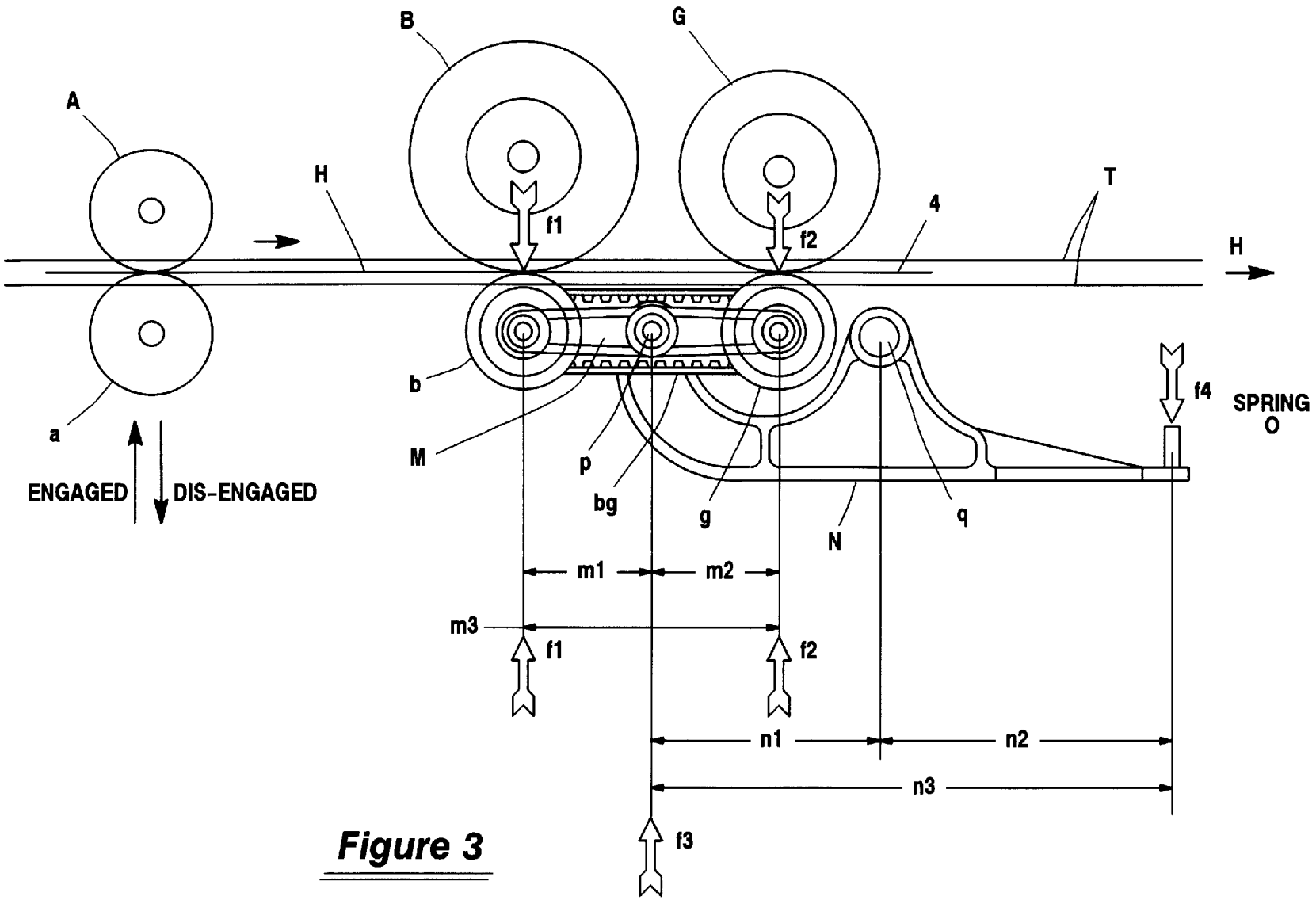
FIG. 3 is an enlargement of part of FIG. 2, with salient features further modified and added-to; with FIGS. 3*a,* 3*b,* 3*c* showing details of idler-spacer arm M, and support arm N; while FIG. 3*d* highlights related forces and dimensions.

Solutions (FIGS. 2,3):

This disclosure describes a design concept, shown in FIGS. 2 and 3, that minimizes such disruption of a document as it passes through the optical encoder roller pair G-g, while yet also allowing the pinch force on roller g to be optimized to insure accurate speed readout.

When the document, H, traveling at 3.5 ips, passes between roller pair B-b which is being driven at a speed to produce 100 ips document speed, drive roller B starts to slip on the document, while idler roller b, which is not driven, slows to the speed of the document and continues to roll with the surface of the document. When idler a is retracted, the document is accelerated to 100 ips by roller B (and C) and idler b is accelerated by the document as the document accelerates.

The mechanism disclosed here as a feature hereof—couples idler roller g to idler roller b (e.g., preferably via a timing belt bg), so that idler roller g rotates at the same speed as b. The engagement idler force on roller b need not be changed, thus the necessary control over document speed by roller pair A-a is not affected. Likewise the idler force on idler roller g can be optimized to minimize slip of optical encoder drive roller G, insuring that an accurate speed readout will be obtained.

With roller g rotating at the speed of roller b, (which is rotating to match the speed of the document) roller G will, in effect, rotate, with roller g at the document speed, and the leading edge of the document will now enter a roller pair rotating at the speed of the document—thus disruption of the document's travel will be minimized regardless of idler g's pinch force.

As soon as the document is between rollers G-g, the document will begin driving roller G, and the optical encoder coupled thereto. Idlers b and g will continue to rotate at document speed and drive roller B will continue (unsuccessfully) to try to drive the document at 100 ips.

When the document is released, by roller a being retracted, drive roller B will start to accelerate the document to 100 ips and idlers b and g, and optical encoder roller G, will be accelerated by the document, and at the same rate as the document. The acceleration torque on roller G is equal to the coefficient of friction of roller G on the document times the idler force of roller g times the radius of roller G.

The radius of roller G is dictated by the need to obtain a minimum of 80 encoder pulses per inch of document and the physical package constraints of the system, or one can mount the encoder offset to roller G and coupled to be rotated by G, but at a different rpm, designed to output 80 pulse/in. The coefficient of friction and the idler roller force are selected to provide an acceleration force large enough to overcome the inertia of the optical encoder and roller G and bearing loads at the maximum possible document acceleration rate.

With rollers b and g so tied together by timing belt bg to eliminate the possibility of slip, the center distance between the rollers b,g must be precisely controlled—e.g., preferably by mounting them on a common spreader-arm, M as in FIGS. 3, 4 (rollers b and g cannot be mounted from a fixed frame because they must be free to accommodate and ride over any varying thickness contours of the documents. Since idlers b and g must also be free to independently move to ride over the contours of the document, arm M is preferably mounted on, and pivots about, a pivot post p which is mounted on the end of a suspension-arm N, cantilevered-out from a pivot post q fixedly mounted on a fixed machine wall. The Pivot post p is thus free to move as either roller b or g moves because arm N is mounted on, and pivots about, its own pivot post q (e.g., also see FIG. 4). This is important functionally-speaking, because without arm N, any movement of either roller b or g as it rolled over document contours would be directly transmitted to the other roller, increasing or decreasing engagement pressure and harmfully upsetting the forces necessary to control the document.

A First force $f_1$ on roller b (FIGS. 3, 3*d*) is a known constant, dictated by the present design and the requirement that roller pair A-a must always control document speed when engaged. A Second force $f_2$ on roller g is set by the need to minimize slip of roller G on an accelerating document. Thus, the force $f_3$ that arm N must place on arm M at pivot p can be calculated by the relation $f_3=f_1+f_2$. Force $f_3$ (e.g. from spring O, as below) thus biases arm M to produce forces $f_1$ and $f_2$.

The position of pivot p on spreader arm M is dictated by the ratio of $f_1$ to $f_2$, with arm M designed so that $m_1$, the distance from pivot p to roller b, (see FIGS. 3, 3*d*) and $m_2$, the distance from pivot p to roller g, are set by the formula $m_1/m_2=f_2/f_1$. The overall length of arm M, or $m_1+m_2$, is equal to the centerline to centerline distance between roller B and G—and this is dictated by design geometry.

The design of bias arm N is dictated by the requirement to provide force $f_3$, as calculated above, at pivot p. This force is preferably generated by spring O acting on the opposite, proximal end of arm N. The force provided by spring O is determined by the formula $f_4=f_3*(n_1/n_2)$, with $n_1$ the distance from pivot p to pivot q on arm N and $n_2$ the distance from pivot q to spring O, and $n_1+n_2$ equal to the distance from pivot p to the spring O. [i.e., the effective length of arm N] Any number of combinations of values for $n_1$, $n_2$ and $f_4$ will provide the proper force $f_3$ so the best combination to fit the system under design will dictate the proper solution.

Variations:

Workers will recognize that, where FIG. 1 had small rollers b, g mounted from a nearby fixed member (e.g. button of track T), insertion of spreader-bar M (e.g. FIG. 3*a*) on its pivot p will be otherwise mounted. Now, in some instances (e.g. where space allows) pivot p can be journaled in a suspension nearby, and this can include spring means for the entire (b, g, M, p) assembly—with spring bias to rolls b, g determined by their lever arm dimensions (distances $m_1$, $m_2$ from p), as workers will appreciate.

But here, space constraints worked against the foregoing, so I found a better place for such a spring (see O, $f_4$ in FIGS. 3*a*, 3*c*, 3*d*, 4*a*) somewhat off to the right, and coupled force $f_4$ thereof to pivot p via bias arm N.

Now, I also found that this arrangement (e.g. FIG. 3) didn't deliver optimal spring-bias forces $f_1$, $f_2$ on roll b, g—so rather than redesign (re-dimension, e.g. so $m_1=m_2$, etc.) bar M and arm N, I simply added a bias-supplement, spring S (FIGS. 3*a*, 3*b*, 3*c*) on one side of M, giving sufficient added bias to optimally increase $f_2$, and decrease $f_1$ (spring S is a flexure leaf of suitable length complete one end of bar M and bent against the underside W of track T—or otherwise implemented, as workers will appreciate).

FIGS. 4A, 4B respectively provide exploded and assembled views of the described idler/belt mechanism b, g, b-g and mounting arms M, N, etc.

FIG. 4*c* is an exploded view of drive rolls B, C, D, encoder G and idlers b, g mounted more conventionally, as in FIG. 1.

Adding Spring S:

With a modified arrangement (FIGS. 3*a*, 3*b*, 3*c*), a bias spring S is added, so that $f_1+f_2+f_s=f_3$ ($f_3$ is determined by the force of the spring O used to provide force $f_4$ as described above; and $f_2=[(f_1*m_1)+(f_3*(m_1+s_1)]/m_2$ For example, in a system for the MJE endorser system in the DP500, $f_3$=4 oz, $s_1$=1", $m_1=m_2$=0.82" and $f_3$=17.9 oz.

Plugging these values into the above equations yields values of $f_1$=2.5 oz. and $f_2$=11.4 oz.,—these produce the required low drive forces on the document by drive roller B and high drive forces by the document on roller G.

The end result is that the more addition of this one spring (S) to the assembly and changing spring force f4 from 5 oz. To 14 oz. Increased the idler force at roller g by 356%, while reducing the force at roller b 21%. This was accomplished without changing the existing tooling or modifying any parts, as shown in FIG. 3 (*b*).

Results:

It will be apparent that my aforedescribed invention is apt for effecting the objects mentioned; e.g., to provide a low-velocity document-handling station to be selectively used to provide an associated floating roller with encoder means coupled to rotate therewith, driven only by a passing document selectively engaged therewith, and adapted to output document-travel pulses to an endorser, with separator-arm means (M) mounting a pair of low-velocity rollers (b,g) in spaced relation, and with timing-belt means coupling these rollers in synchronism, along with suspension arm means (N) for mounting this separation-arm means and transmitting needed engagement bias through arm M.

It will be evident that this embodiment can provide accurate measurement of document speed and acceleration, while minimizing disruption of document travel and any associated document damage, and can allow precise and selectable control of the document speed by any roller pair, by the selection of the proper arm lengths, pivot positions and spring forces.

Workers will appreciate that an embodiment like the foregoing can accommodate my stated objectives; i.e. it allows the optical encoder (roller G) to accurately, simply directly monitor document speed, yet without deleteriously affecting document transport, the encoder or the endorser.

FIG. 3*d* highlights the aforementioned forces and dimensions.

Of course, many modifications to the preferred embodiments described previously are possible without departing from the spirit of the present invention. For example, there are other different ways to provide the mountings and controls described in the present embodiments, and the balance of forces (e.g. on rollers B/b, G/g on arms N and M—and on spring S), within the invention embraced by the present claims.

What is claimed is:

1. An apparatus for processing documents comprising:

a processing station having a sheet speed measuring device coupled thereto; and, a sheet transport array for advancing sheets along a track at a desired speed past said processing station, wherein said sheet transport array comprises:

a drive roller assembly including at least a drive roller and a drive idler, said drive roller for driving an advancing sheet at least at said desired speed toward said process station;

a second roller assembly including at least a second roller and a second idler, said second idler moving at the speed of said advancing sheet; and a floating roller assembly including at least a floating roller and a floating idler, said floating idler for coupling said second idler so as to move at the same speed as said second idler and said advancing sheet, said floating roller and said floating idler having as pinch point with a pinch force such that said floating roller and said floating idler move at the same speed, said floating roller coupled to said speed measuring device so that said speed measuring device measures the speed of said advancing sheet prior to the advancing sheet making contact with said floating roller assembly.

2. The apparatus for processing documents of claim 1 in which said coupling between said floating idler and said second idler is a belt drive.

3. The apparatus for processing documents of claim 1, in which said floating roller is driven by said advancing sheet after said advancing sheet makes contact with said pinch point of said floating roller assembly such that the speed of the document begins driving the speed measuring device.

4. The apparatus for processing documents of claim 3 in which said coupling between said floating idler and said second idler is a belt drive.

5. An apparatus for processing documents comprising:

a processing station having a sheet speed measuring device coupled thereto; and, a sheet transport array for advancing sheets along a track at a desired speed past said processing station, wherein said sheet transport array comprises:

a drive roller assembly including at least a drive roller and a drive idler, said drive roller for driving an advancing sheet at least at said desired speed toward said process station;

a second roller assembly including at least a second roller and a second idler, said second idler moving at the speed of said advancing sheet; and a floating roller assembly including at least a floating roller and a floating idler, said floating idler for coupling said second idler so as to move at the same speed as said second idler and said advancing sheet, said floating roller and said floating idler having as pinch point with a pinch force which causes said floating roller and said floating idler to move at the same speed, such that said advancing sheet is not slowed down when it makes contact with said pinch point of said floating roller assembly, said floating roller coupled to said speed measuring device so that said speed measuring device measures the speed of said advancing sheet.

6. The apparatus for processing documents of claim 5 in which said coupling between said floating idler and said second idler is a belt drive.

7. The apparatus for processing documents of claim 4 in which said sheet speed measuring device provides said control signals to control the operation of said process station.

8. The apparatus for processing documents of claim 5 in which said process station is an endorser.

9. The sheet apparatus for processing documents of claim 5 in which said sheet speed measuring device is an optical encoder.

10. The apparatus for processing documents of claim 5 in which said floating idler is mounted on an arm, said arm mounted on a first pivot to allow said floating idler to adjust to different thickness sheets.

11. The apparatus for processing documents of claim 10 in which said second idler is mounted to said arm, to allow said second idler to adjust to different thickness sheets, said second idler being separated from said floating idler by a defined distance to accommodate said coupling between said second idler and said floating idler.

12. The apparatus for processing documents of claim 10 in which said first pivot is movably mounted so as to allow movement of said arm such that said second idler and said floating idler can both adjust to changes in the thickness of said sheets.

13. The apparatus for processing documents of claim 12 in which said movable mounting of said first pivot is a suspension arm cantilevered out from a second pivot.

* * * * *